US009072376B2

(12) United States Patent
Wagner

(10) Patent No.: US 9,072,376 B2
(45) Date of Patent: Jul. 7, 2015

(54) TEACHING STATION WITH AN ADJUSTABLE LECTERN SECTION

(71) Applicant: Academia Furniture, LLC, Wood-Ridge, NJ (US)

(72) Inventor: Y. Isaac Wagner, Monsey, NY (US)

(73) Assignee: Academia Furniture, LLC, Passaic, NJ (US)

( * ) Notice: Subject to any disclaimer, the term of this patent is extended or adjusted under 35 U.S.C. 154(b) by 69 days.

(21) Appl. No.: 14/024,731

(22) Filed: Sep. 12, 2013

(65) Prior Publication Data

US 2015/0068432 A1 Mar. 12, 2015

(51) Int. Cl.

| | |
|---|---|
| ***A47B 37/00*** | (2006.01) |
| ***A47B 83/00*** | (2006.01) |
| ***A47B 19/06*** | (2006.01) |
| ***A47B 83/04*** | (2006.01) |
| ***A47B 88/04*** | (2006.01) |

(52) U.S. Cl.

CPC ..... *A47B 83/001* (2013.01); *A47B 19/06* (2013.01); *A47B 83/045* (2013.01); *A47B 88/04* (2013.01)

(58) Field of Classification Search

CPC ..... A47B 2200/0043; A47B 2200/0044; A47B 2200/0046; A47B 21/02; A47B 21/00; A47B 83/04; A47B 51/00

USPC ..... 108/50.01, 147, 147.21, 147.19, 3, 2, 7, 108/10; 312/196, 195, 249.12, 249.13, 306, 312/312, 317.3

See application file for complete search history.

(56) References Cited

U.S. PATENT DOCUMENTS

| | | | | |
|---|---|---|---|---|
| 8,486 | A * | 11/1851 | Hammitt | 108/3 |
| 1,303,280 | A * | 5/1919 | Fliedner | 108/3 |
| 2,931,685 | A * | 4/1960 | Butler | 312/196 |
| 3,395,959 | A * | 8/1968 | White | 312/317.3 |
| 4,576,424 | A * | 3/1986 | Nelson | 312/231 |
| 4,852,500 | A * | 8/1989 | Ryburg et al. | 108/105 |
| 4,932,332 | A * | 6/1990 | Noda | 108/50.02 |
| 5,101,736 | A * | 4/1992 | Bommarito et al. | 108/7 |
| 5,242,217 | A * | 9/1993 | Gonnet | 312/194 |
| 5,791,259 | A * | 8/1998 | Mansfield et al. | 108/6 |
| 5,857,415 | A * | 1/1999 | Richard | 108/50.01 |
| 6,312,069 | B1 * | 11/2001 | Weng | 312/312 |
| 6,435,112 | B1 * | 8/2002 | Insalaco | 108/147.21 |
| 6,463,862 | B1 * | 10/2002 | Kuhlman et al. | 108/50.01 |
| 6,536,356 | B2 * | 3/2003 | Krieger et al. | 108/50.01 |
| D528,822 | S * | 9/2006 | Newhouse | D6/429 |
| 2006/0065167 | A1 * | 3/2006 | Chi et al. | 108/50.02 |
| 2008/0060560 | A1 * | 3/2008 | Chen | 108/50.01 |
| 2012/0025681 | A1 * | 2/2012 | Ton | 312/309 |

OTHER PUBLICATIONS

"Trend Podium Desk," MooreCo Inc., Oct. 19, 2012, Temple, Texas.

* cited by examiner

*Primary Examiner* — Jose V Chen

(74) *Attorney, Agent, or Firm* — Weiss & Arons LLP

(57) ABSTRACT

This disclosure relates to a teaching station that includes a lectern section and a desktop. A method for adjusting a lectern portion of a teacher's station is provided. The method may include releasing a lock wherein the lock, when engaged, fixes the position of the lectern portion with respect to the teacher's station. In response to releasing the lock, the method may further include adjusting a height of the lectern portion relative to a desktop portion of the teacher's station, while maintaining an angle of the of a table-top of the lectern portion in a fixed orientation with respect to the desktop. The method may further include applying the lock to fix the height of the portion of the table-top.

8 Claims, 8 Drawing Sheets

TEACHING STATION WITH AN ADJUSTABLE LECTERN SECTION

FIELD OF INVENTION

This disclosure relates to a teaching station that includes a desktop and an adjustable lectern section.

BACKGROUND

A teacher may wish to sit at a desk and utilize a desktop. The teacher may position books, lecture notes or other teaching material on the flat desktop. At times a teacher may wish to stand and lecture to the class or otherwise present material while in a standing position. When presenting material in a standing position, the teacher may transfer the teaching material from the flat desktop to a lectern. If the teacher wishes to return to a sitting position, the teacher must once again transfer the teaching material—from the lectern to the flat desktop. Each transfer of the teaching material may consume time that may have been utilized to convey information to the students.

When teaching in a standing position, each teacher may adjust a lectern to a position that meets his or her personal preference.

A classroom may be shared by two or more teachers. Therefore, in addition to time required to transfer teaching material between a flat desktop and the lectern, a teacher may spend teaching time adjusting or repositioning the lectern to his or her preferences.

A lectern may be large, and, when not in use, may consume valuable classroom space. An adjustable lectern may pose a safety hazard. Fingers or other extremities may be caught in moving parts of an adjustable mechanism. The moving parts of the adjustable mechanism may cause lacerations, bruises or other bodily injuries to the fingers or extremities.

Some lecterns may not be adjustable. For example, a height of a lectern may not be adjustable. Some teachers may be uncomfortable with a default position of a lectern in the classroom and may therefore refrain from presenting material in a standing position.

It would be desirable to provide a teaching station that includes a desktop and an adjustable lectern section of the desktop (hereinafter, the "lectern section"). Integration of the adjustable lectern section for use with the desktop may reduce time spent and teacher inconvenience when switching from teaching in a sitting position to teaching in a standing position.

It would be desirable to provide an adjustable lectern section of a teaching station that is proximal to a desktop. It would further be desirable to provide an adjustable lectern section associated with a desktop, whereby the lectern section is preferably easily configurable in a variety of positions to meet the preferences of different teachers.

It would further be desirable to provide an adjustable lectern section of a desktop that reduces a likelihood of sustaining a bodily injury when adjusting the lectern section.

Therefore, it would be desirable to provide apparatus and methods for a teaching station that includes an adjustable lectern section.

DETAILED DESCRIPTION

Figure 1:
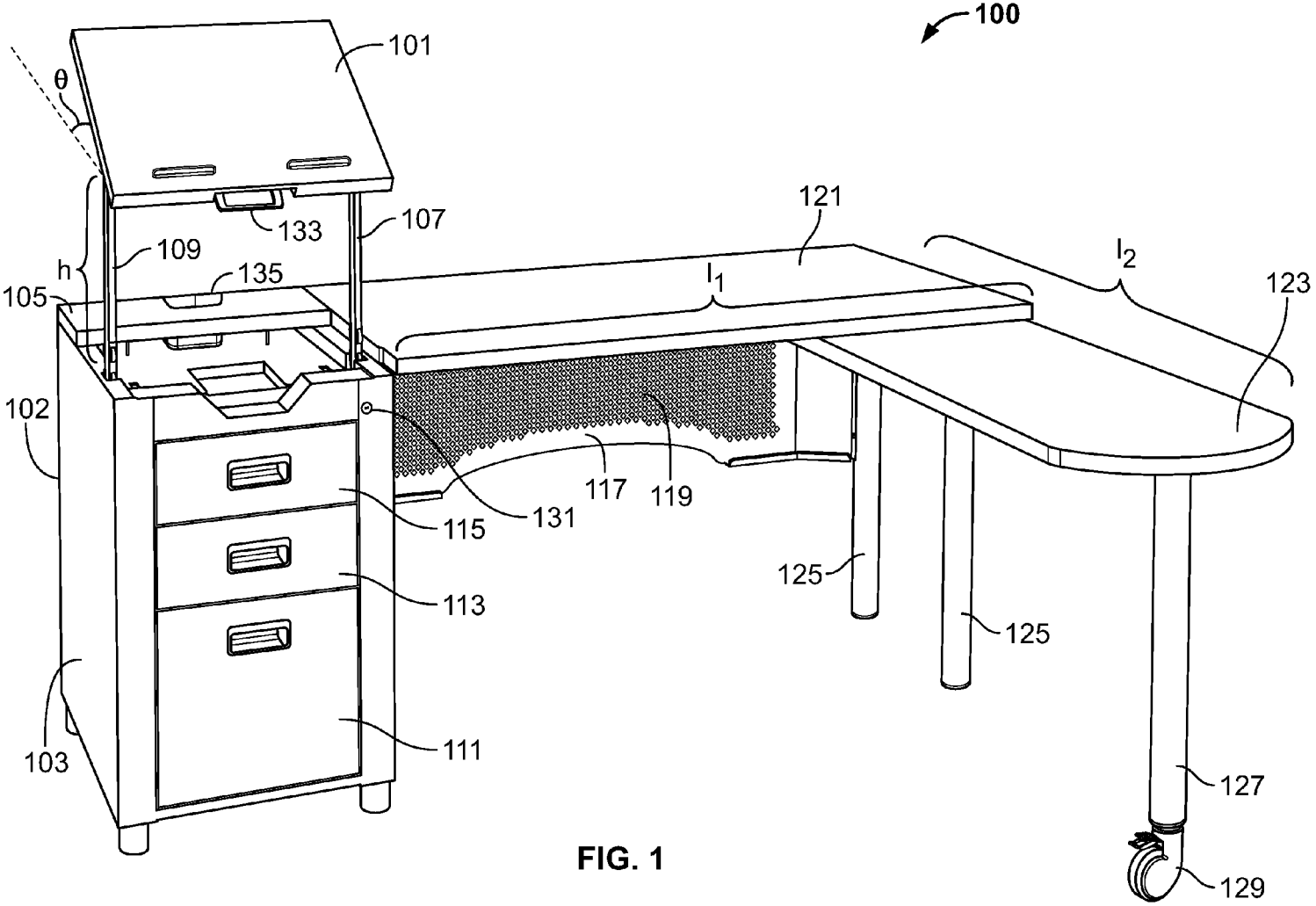
FIG. 1 shows illustrative apparatus in accordance with principles of the invention.

Apparatus may include a teaching station. The teaching station may include a desktop. The teaching station may include a lectern section. The lectern section may be adjustable relative to desktop of the teaching station. A table-top of the lectern section may be adjustable relative to the desktop in one dimension. The table-top of the lectern section may be adjustable relative to the desktop in two or more dimensions.

The desktop portion may be mounted on a base of the teaching station. The lectern may be affixed to at least one leg. In a preferred embodiment, the lectern may be affixed to a first leg and a second leg. The first leg and the second leg may slide within the base. A first housing may slidably couple the first leg to the base. A second housing may slidably couple the second leg to the base.

Movement of a leg within a housing may allow a teacher or other user (collectively hereinafter, "teacher") to adjust a height of the lectern section relative to the desktop. The lectern section may be adjusted by applying a force to the lectern section. For example, the lectern section may be pulled up from the base, thereby increasing a height of the lectern section. The lectern section may be pushed down relative to the base, thereby lowering a height of the lectern section.

The teaching station may include a safety mechanism. The safety mechanism may restrict movement of the table-top of the lectern section relative to the base in a first dimension. The safety mechanism may restrict movement of the table-top of the lectern section relative to the base in two or more dimensions. The safety mechanism may control movement of the legs within the housings. The safety mechanism may limit an acceleration of the lectern section when adjusting a height of the lectern section. The safety mechanism may include a lock. The lock, when engaged, may maintain a height of the lectern section relative to the desktop. The lock, when disengaged, may allow an adjustment of the height.

The teaching station may include an actuator. The actuator may be configured to disengage the lock. The actuator may be affixed to the lectern section. The actuator may be affixed to an underside of the lectern section. The actuator may be affixed to the base. The actuator may be affixed to the leg. The actuator may be affixed to any suitable component of the teaching station.

The actuator may be moveable. The actuator may be pressed, pulled, pushed or configured to move in any suitable direction. The actuator may move with respect to the lectern section, base or other point of affixation to the teaching station. For example, the actuator may be configured to pivot with respect to the lectern section. The actuator may be configured to translate with respect to the lectern section. The actuator may be configured to move in any suitable manner.

A force may be applied to the actuator. The force may be applied by a person such as a teacher, or other suitable individual. The force may be a mechanical force. The force may be an electromechanical force. The force may be a magnetic force. The force may be applied by a motor. The applied force may move the actuator. Movement of the actuator may disengage the lock. Movement of the actuator may not disengage the lock.

When the lock is disengaged, the height of the lectern section may be adjusted. The lock may be biased in a default position. The default position may correspond to engagement of the lock. The force may move the lock out of the default position. Movement of the lock out of the default position may correspond to disengaging the lock.

When the force is applied to the actuator, the lock may remain disengaged and allow for adjustment of the height. The lock may remain disengaged as long as the force is applied to the actuator. The height of the lectern section may be adjustable as long as the force is continuously applied to the actuator.

The teaching station may include a cable. The cable may include a first end. The first end of the cable may be affixed to a first portion of the teaching station. The cable may include a second end. The second end of the cable may be affixed to a second portion of the teaching station.

The first end of the cable may be coupled to the actuator. Movement of the actuator may introduce a tension into the cable. For example, the actuator may include a claw. The first end of the cable may include a stop or a bulbous end. The claw may be configured to grasp the bulbous end. Movement of the actuator may result in the claw grasping the bulbous end and pulling the cable. The pulling of the cable may introduce tension into the cable.

The second end of the cable may be coupled to the safety mechanism. The safety mechanism may include a cam. The second end of the cable may be coupled to the cam. The cam may be configured to rotate about a pivot. Rotation of the cam about the pivot may engage and/or disengage the lock of the safety mechanism.

The cam may include a claw. The second end of the cable may include a bulbous end. The claw of the cam may be configured to grasp the bulbous end. When a force is applied to the actuator and a tension is introduced into the cable, the bulbous end of the second end of the cable may pull the claw of the cam, thereby rotating the cam and disengaging the lock.

The base of the teaching station may include an internal frame. The base may have a width. The base may have a length. The internal frame may have a width. The internal frame may have a length. The width of the internal frame may be less than the width of the base. The length of the internal frame may be less than the length of the base. The internal frame may be configured to be positioned within an area enclosed by one or more outer panels of the base.

The internal frame may include a track. The track may be configured to hold a drawer within the base. The track may hold a shaft within the base. The drawer may slide along the track. The track may be mounted to the internal frame. The track may include ball bearings, wheels or other suitable friction reducing elements that allows a drawer to slide easily along the track. Sliding the drawer along the track may correspond to sliding the drawer into, or out of, the base. The internal frame may include one or more tracks for holding one or more drawers.

The safety mechanism may be affixed to the internal frame. Components of the safety mechanism may be positioned between the internal frame and an outer panel of the base. When a drawer mounted on the track is closed, components of the safety mechanism may be positioned between the closed drawer and an outer panel of the base. The safety mechanism may be affixed to the internal frame in a manner that does not impede opening and/or closing of the drawer. The safety mechanism may be affixed to the internal frame in a manner that does not compromise access to the shelf.

The base may include an access mechanism that prevents an unauthorized user from opening the drawer or accessing a shelf inside the base. The access mechanism may include a keyed access port for engaging and/or disengaging the access mechanism. The access mechanism may be mounted to the internal frame.

The teaching station may include a pressure source. The pressure source may be configured to exert any suitable quantity of pressure. The pressure source may be any suitable pressure source. Exemplary pressure sources may include a spring, hydraulic lift or pneumatic cylinder. The pressure source may be housed within a fixed member. The pressure source may be configured to exert pressure on a moveable member. The fixed member may be affixed to the base. The fixed member may be affixed to the internal frame.

The lock of the safety mechanism may maintain a position of the moveable member relative to the fixed member. The position of the moveable member relative to the fixed member may correspond to a height of the lectern section relative to the desktop. When the lock is engaged, the moveable member may not be adjusted relative to the fixed member and the height of the lectern section may not be adjusted. When the lock is disengaged, the moveable member may be adjusted relative to the fixed member and the height of the lectern section may be adjusted.

For example, the lock may be a brake of a pneumatic cylinder. The brake may be engaged or disengaged by an actuator affixed to the underside of the lectern section. A "squeezing" of the actuator may pull a cable. The pulling of the cable may rotate a cam and release the brake.

The moveable member may be affixed to a rotatable bar. The rotatable bar may be configured to rotate about an $\text{axis}_{RB}$. $\text{Axis}_{RB}$ may be oriented perpendicular to a length of the base and parallel to a width of the base. $\text{Axis}_{RB}$ may be perpendicular to one or more legs of the lectern section.

The rotatable bar may have a length. The length of the rotatable bar may be less than a width of the base. The length of the rotatable bar may be equal to or longer than a width of the internal frame.

The rotatable bar may include a moment arm. The moment arm may be oriented in direction perpendicular to a length of the rotatable bar. The moment arm may be centered with respect to the length of the rotatable bar. The moveable member may be affixed to the moment arm. The moment arm may be a brace affixed to the rotatable bar. Pressure exerted by the pressure source may extend the moveable member and rotate the rotatable bar about $\text{axis}_{RB}$. Extension of the moveable member by the pressure source may reduce work applied by a teacher to increase a height of the lectern section.

In some embodiments, pressure exerted by the pressure source may raise the height of the lectern section without additional work by a teacher. In some embodiments, pressure exerted by the pressure source may raise the height of the lectern section with only a de-minimis force or minimal work expended by the teacher.

An extension may be affixed to the rotatable bar. The extension may be a first extension. The extension may extend in a direction perpendicular to a length of the rotatable bar.

A second extension may be affixed to the rotatable bar. The second extension may include one or more properties of the first extension. The extension may be affixed to a first end of the rotatable bar. The second extension may be affixed to a second end of the body. The first extension may be separated from the second extension by a distance corresponding to the length of the rotatable bar. The extension may extend from the rotatable bar to a leg of the lectern section. The rotatable bar may be rigidly affixed to the extension. The extension may extend beyond a point of affixation to the rotatable bar. The extension may be rotatably affixed to the internal frame.

The rotatable bar may be positioned relative to the internal frame. A distance from $axis_{RB}$ to a point at which an extension is affixed to the rotatable bar may correspond to an offset. The offset may position the rotatable bar away from $axis_{RB}$. The offset may position the $axis_{RB}$ within the internal frame.

The first extension, second extension and the rotatable bar may form a "U" shaped component of the teaching station. In some embodiments, the rotatable bar, the first extension and the second extension may be formed from a unitary construction. The first extension may extend from the internal frame to a first leg of the lectern section. The second extension may extend from the internal frame to a second leg of the lectern section. The first extension may be parallel to the second extension.

The first and second extensions may remain substantially parallel to each other during rotation of the rotatable bar. Pressure applied to the rotatable bar may rotate the first and second extension about $axis_{RB}$. A rigid affixation of the first and second extension to the rotatable bar may result in the first and second extension rotating about $axis_{RB}$ at identical angular velocities.

An extension affixed to the rotatable bar may rotate within a space defined, at least in part, by the internal frame and an outer panel of the base. Rotation of the extension may not impede a sliding of a drawer along a track mounted on the internal frame.

An extension may be rotatably affixed to a leg of the lectern section. The extension may be rotatably affixed to the leg via a connector. The connector may be a pin, screw, rivet or any other suitable connector. The connector may allow the extension to rotate with respect to a leg of the lectern section.

An extension may be expandable. The extension may expand when pressure is applied to the rotatable bar by the pressure source. The extension may expand during a rotation of the extension about $axis_{RB}$. The extension may expand when the lectern section is raised with respect to the base. The extension may contract when the lectern section is lowered with respect to the base. The extension may expand when the lectern section is lowered with respect to the base.

The leg of the lectern section may be inserted into a housing. The leg may slide within the housing. The leg may move vertically within the housing. The leg may move parallel to a height of the base. Movement of the leg may correspond to adjusting a height of the lectern section. The housing may include a slot. The slot may be elongated. A first end of a connector may be affixed to the extension. A second end of the connector may be affixed to the leg. A body of the connector may pass though the slot.

The slot in the housing may limit movement of the leg within the housing. An end of the slot may form a stop that restricts movement of the connector body and corresponding rotation of the extension. The slot may limit a maximum height of the lectern section.

The pressure source may apply pressure to the rotatable bar, and via rotation of the extension, slide the leg within the housing. The sliding of the leg within the housing may correspond to adjusting a height of the lectern section. Pressure applied by the pressure source may reduce a magnitude of work that a teacher would need to exert to raise a height of the lectern section.

For example, when the lock of the safety mechanism is disengaged, the pressure source may exert pressure that rotates the rotatable bar, rotates the extension and slides the leg of the lectern section within the housing thereby increasing a height of the lectern section.

The lectern section may be lowered when a teacher applies a downward-directed force to the lectern section. To lower the lectern section, the teacher may apply a pressure that is greater than pressure exerted by the pressure source. The pressure source may provide a threshold level of pressure that reduces an ability of a gravitational force to lower a height of the lectern section and the lock is disengaged.

If the gravitational force were allowed to accelerate the lectern section downward, (i.e., lowering the height of the lectern section), an extremity of the teacher, student or other bystander may be caught between an underside of the lectern section and the base, presenting a risk of injury to the extremity. The pressure source may limit downward acceleration of the lectern section. For example, limiting gravitational acceleration of the lectern section by a threshold value may reduce sudden downward acceleration of the lectern section and thereby reduce a risk of trauma resulting from a "squeezing" of a body part between the lectern section and the base.

At least one of the legs affixed to the table-top may include a hollow portion. A cable may pass through the hollow portion of the leg. The cable may pass from an actuator affixed to an underside of the lectern section into the hollow portion of the leg. The cable may pass through the hollow portion of the leg and through at least a portion of the housing encasing the leg. The cable may exit the housing at, or near, a point proximate to a floor of the base. The cable may run along the floor of the base. The cable may run along the floor of the base in space bordered, at least in part, by the internal frame and an outer panel of the base.

The cable may link the actuator to a lock. Movement of the actuator may engage and/or disengage the lock thereby applying or releasing a brake restraining the pressure source. The cable may include a stop that fits into a claw of a cam. Rotation of the cam may engage and/or disengage the lock in response to increased tension in the cable.

The cable linking the actuator to the lock may be encased in a cladding. The cladding may have a first bending resistance. The cable may have a second bending resistance. The first bending resistance may be higher than a second bending resistance of the cable. The cladding may maintain a threshold tension in the cable. The cladding may maintain a position of the cable. The cladding may prevent the cable from impeding a sliding of the drawers supported by the internal frame.

The actuator may be a first actuator. The teaching station may include a second actuator. The second actuator may be affixed to an underside of the lectern section. The second actuator may be affixed to the base. The second actuator may be affixed to the leg. The second actuator may be affixed to any suitable component of the teaching station.

The second actuator may control a tilt of the lectern section. The tilt may be measured with respect to a surface of the base. The tilt may be measured with respect to a non-adjustable section of the desktop.

The lectern section may include a hinge. The hinge may include a first wing. The hinge may include a second wing. The first wing may be affixed to a leg of the teaching station. The first wing may be welded to the leg. The second wing may be affixed to the lectern section. The second wing may be affixed to an underside of the lectern section. The second wing may be affixed to the underside of the lectern section using one or more fasteners. The first wing and the second wing may be linked at a pivot $point_H$. The first wing may rotate about pivot point$_H$. The second wing may rotate about pivot point$_H$. Rotation of the second wing relative to the first wing may correspond to adjusting a tilt of the lectern section.

The second wing may include a curved slot. The curved slot may include a plurality of notches. Each notch may include a pair of semicircularly shaped notches. Each of the notches may correspond to a lockable tilt position of the lectern section. A detent may fit into each notch in the second wing. The detent may be circularly shaped. The detent may be removed from the notch by applying a force to the second actuator. When the detent is removed from the notch, the lectern section may rotate freely about the pivot point of the hinge.

The detent may be affixed to an elongated member. The elongated member may pass through the slot in the second wing. The elongated member may be slidably positioned within a bearing. The bearing may be affixed to the first wing. The bearing may be welded to the first wing.

The elongated member may pass through a casing. The casing may be affixed to the underside of the table-top of the lectern section. The casing may be affixed to a first wing of a hinge. The casing may be affixed to the first wing by a connector that passes through a curved slot in the second wing. The second wing may include two curved slots. The elongated member may pass through a first curved slot in the second wing. The connector coupling the casing to the first wing may pass through a second curved slot in the second wing.

The elongated member may be maintained in a default position within the bearing by a biasing member. The biasing member may be a spring. The biasing member may be positioned between a portion of the casing and a first stop affixed to the elongated member. The default position of the elongated member may correspond to a locked tilt position. The default position of the elongated member may correspond to a detent affixed to the elongated member being positioned within one of the notches in the second wing.

A lever may be positioned within the casing. The elongated member may pass through the lever. The elongated member may include a second stop. The second stop may be positioned adjacent to the lever at the point at or near where the elongated member passes through the lever.

The second actuator may include a claw. A first end of a cable may be held by the claw. A second end of the cable may be held by the lever. Movement of the actuator, such as by a squeezing of the actuator, may result in the claw grasping the first end of the cable and increasing a tension in the cable. Increasing the tension in the cable may correspond to a pulling of the cable.

In response to a force applied to the second actuator, the claw may grasp the cable and pull the cable. Pulling the cable may rotate the lever about a pivot point$_L$. Rotation of the lever about the pivot point$_L$ may exert pressure on the second stop of the elongated member, thereby shifting the elongated member within the bearing.

Shifting the elongated member may result in a compression of the spring or other suitable biasing member within the casing. Shifting the elongated member may move one or more detents out of one or more notches in one or more second wings.

When the detent affixed to the elongated member is engaged with a notch in the second wing, the tilt of the lectern section may not be adjustable. The teaching station may include a plurality of notches. Each of the plurality of notches may be offset by an angular distance. Each notch may correspond to an angle-of-tilt between the lectern section and a surface of the base. Shifting the elongated member, thereby moving the detent out of a notch, may allow the teacher to increase or decrease an angular tilt of the lectern section. Releasing the second actuator may allow the biasing member to re-position the detent into one of the plurality of notches and prevent adjustment of the tilt.

If a teacher releases the second actuator at a tilt position that is between two notches, the biasing member may engage the detent with one of the plurality of notches when the detent is aligned with one of the two notches.

The hinge may be a first hinge. The teaching station may include a second hinge. The second hinge may include one or more features of the first hinge. The first hinge may rotatably join the lectern section to a first leg. The second hinge may rotatably join the lectern section to a second leg.

For example, the teaching station may include two hinges. Each hinge may include a first wing and a second wing. A first hinge may be affixed to a first leg. A second hinge may be affixed to a second leg. The first hinge may include a first set of notches and the second hinge may include a second set of notches. The first set of notches may be engaged by a first detent. The second set of notches may be engaged by a second detent. The first and second detents may be joined to each other by an elongated member. The elongated member may be shifted in response to a force applied to a second actuator. The force applied to the second actuator may rotate the lever in the casing, apply pressure to a stop affixed to the elongated member and shift the elongated member. Rotation of the lever may apply pressure to a stop affixed to the elongated member.

In a preferred embodiment, the elongated member may include a first detent and a second detent. The first detent may be positioned adjacent to a first set of notches in a second wing. The second detent may be positioned adjacent to a second set of notches in a second wing. The first detent and the first set of notches may be positioned adjacent to the first leg of the lectern section. The second set of notches and the second detent may be positioned adjacent to the second leg of the lectern section.

The second actuator may rotate the lever about the pivot point. The rotation of the lever about the pivot point may shift the first detent out of a notch included in the first set of notches. The rotation of the lever about the pivot point may shift the second detent out of a notch included in the second set of notches. The rotation of the lever may substantially simultaneously shift the first and second detents.

The teaching station may include a desktop. The desktop may include sections. The base may include a first section of the desktop. The first section of the desktop may correspond to a surface of the base. The first section of the desktop may lie in a first plane. The first section of the desktop may be rigidly affixed to the base. The first section of the desktop may include one or more ports. The one or more ports may provide access to a power supply, audio input/output, video input/output, USB, VGA, Bluetooth, Ethernet connection or other suitable connections.

The lectern section may correspond to a second section of the desktop. When the lectern section is at a minimum height relative to the base, the lectern section and the first section of the desktop may both lie in the first plane. In some embodiments, the lectern section and the first section may not lie in the same plane.

When a height of the table-top of the lectern section is higher than the base, the lectern section may lie in a second plane. The second plane may be parallel to the first plane. When a tilt of the table-top of the lectern section is adjusted, the second plane may intersect the first plane. The angle of intersection between the first and second plane may correspond to an angular tilt of the table-top of the lectern section relative to the first section of the desktop.

The apparatus may include a third section of the desktop. The third section of the desktop may lie in the first plane. The third section may be separable from the first and second sections. The third section may be inseparable from the first and second sections. The third section may be supported by the base at a first end. The third section may be supported by one or more supporting legs at a second end. A distance between the first end and second end may correspond to a length of the third section.

The desktop may include a fourth section. The fourth section may not lie in the same plane as the first, second and/or third sections. The fourth section may lie in a third plane. The third plane may be parallel to the first plane and/or the second plane. The fourth section may be configured to rotate about an $axis_{FS}$ normal to a surface of the fourth section. The fourth section may have a length. The fourth section may be configured to rotate about $axis_{FS}$ into a position such that the length of the fourth section is at a substantially right angle to a length of the third section.

The fourth section may be configured to rotate about $axis_{FS}$ into a position such that the length of the fourth section is at a position substantially zero degrees from the length of the third section. Rotation of the fourth section about $axis_{FS}$ may expand or contract a footprint of the teaching station.

When the length of the fourth section is substantially zero degrees from the length of the third section, a surface area of the fourth section may be directly below a surface area of the third section. When the length of the fourth section is substantially zero degrees from the length of the third section, the footprint of the teaching station may not include a projection of an area of the fourth section. When the length of the fourth section is substantially ninety degrees from the length of the third section, the footprint of the teaching station may include the area of the fourth section.

The fourth section may be supported at a first end with a connector to the third section. The connector may allow the fourth section to rotate about $axis_{FS}$. The fourth section may be supported at a second end by a supporting leg. The elongated member may terminate in a swivel wheel. The swivel wheel may allow for rotation of the fourth section about $axis_{FS}$. The swivel wheel may sweep out an arc when the fourth section rotates about $axis_{FS}$.

When a height of the lectern section is raised, a teacher may position a book or other lecture material on the table-top of the lectern section. The tilt of the table-top of the lectern section may be adjusted to a viewing angle preferred by the teacher. The table-top of the lectern section may include one or more book-stops. A book-stop may prevent lecture material from sliding off the table-top of the lectern section when a tilt of the table-top is greater than zero degrees. The book-stop may be positioned at a substantially right angle to a planar surface of the table-top.

The book-stop may be configured to rotate. The book-stop may rotate from a position that is at a substantially zero degree angle to a planar surface of the table-top of the lectern section to an angle that is substantially ninety degrees to the planar surface of the table-top. The book-stop may rotate from a position that is at a substantially zero degree angle to a planar surface of the table-top of the lectern section to an angle that is less than ninety degrees with respect to the planar surface of the table-top. In some embodiments, the book-stop may be configured to retract into a thickness of the table-top. In some embodiments, the book-stop may be affixed to an edge of the table-top. A book-stop affixed to the edge of the table-top may not obstruct a surface of the table-top when the table-top lies in the same plane as the first section of the desktop.

The teaching station may include an electric motor. The electric motor may supply a force needed to raise a height of the lectern section. The teacher's station may include a display. The display may be a touch-sensitive screen. The display may allow a teacher to input instructions to the motor. The input may correspond to an adjustment of a height of the lectern section. The display may be lockable to prevent unauthorized and unanticipated adjusting of the lectern section. Locking the display may include requiring entry of a password, biometric characteristic or other access method to unlock the display. When the display is locked, the display may not receive an input and/or an input may not be transmitted to the motor.

In some embodiments, the teaching station may be configured to store a teacher profile. The teacher profile may include a lectern section setting for a teacher. The lectern section settings may include a specified height and/or a specified tilt. The lectern section settings may include a time when the position of the lectern section should be adjusted.

Apparatus and methods described herein are illustrative. Apparatus and methods of the invention may involve some or all of the features of the illustrative apparatus and/or some or all of the steps of the illustrative methods. The steps of the methods may be performed in an order other than the order shown and described herein. Some embodiments may omit steps shown and described in connection with the illustrative methods. Some embodiments may include steps that are not shown and described in connection with the illustrative methods.

Illustrative embodiments of apparatus and methods in accordance with the principles of the invention will now be described with reference to the accompanying drawings, which form a part hereof. The drawings show illustrative features of apparatus and methods in accordance with the principles of the invention. The features are illustrated in the context of exemplary embodiments. It will be understood that features shown in connection with one of the embodiments may be practiced in accordance with the principles of the invention along with features shown in connection with another of the embodiments. It is to be understood that other embodiments may be utilized and structural, functional and procedural modifications may be made without departing from the scope and spirit of the present invention.

Certain embodiments may include a desk. The desk may include a desktop and an adjustable lectern section. The adjustable lectern section may include a table-top, a first leg and a second leg. The desk may also include a base. The base may include a first housing for the first leg and a second housing for the second leg. The desk may further include a safety mechanism configured to lock a position of the adjustable lectern section relative to the desktop. The desk may also include an actuator configured to disengage the safety mechanism. In some embodiment, when the actuator disengages the safety mechanism, the height of the adjustable lectern section of the desktop may be adjusted relative to the desktop.

Certain embodiments may include a method for adjusting a portion of a lectern section. The method may include releasing a lock of a pressure source. In response to releasing the lock of the pressure source, the method may further include adjusting a height of the portion of the lectern section relative to the desktop while maintaining an angle of the table-top of the lectern section in a fixed orientation with respect to the plane of the desktop. The method may yet further include applying the lock of the pressure source to fix the height of the portion of the table-top and/or disengaging a detent from a first notch.

FIG. 1 shows illustrative teaching station 100 (hereinafter, "station 100"). Station 100 includes lectern section 101. Station 100 includes base 102. Legs 107 and 109 may form part of lectern section 101 and be affixed to the table-top of lectern section 101.

Legs 107 and 109 may be affixed to an underside of the table-top of lectern section 101 using a hinge (not shown). The table-top of lectern section 101 may be joined to base 102 via legs 107 and 109.

Station 100 is shown with lectern section 101 positioned at a height h above base 102. Station 100 shows lectern section positioned at a tilt of angle θ relative to base 102.

Station 100 includes actuator 133. Actuator 133 may be used to adjust height h. Actuator 133 may be used to adjust angle θ. Actuator 133 may be configured to adjust height h and angle θ.

Base 102 includes outer panel 103. Outer panel 103 may be one of a plurality of outer panels (not shown). Base 102 includes drawers 111, 113 and 115. Drawers 111, 113 and 115 may slide in and out of base 102. Base 102 includes key port 131. Key port 131 may be used to lock drawers 111, 113 and 115. Locking the drawers 111, 113 and 115 may prevent an opening of at least one of drawers 111, 113 and 115.

Station 100 includes power/data port 135. Power/data ports 135 may provide access to a power outlet. Power/data ports 135 may be retractable into base 102. Power/data ports 135 may provide access to a data connection. Exemplary data connection may include an Ethernet connection, audio connection, video connection, USB, VGA, Bluetooth, other wireless connection or any suitable data connection.

Station 100 includes desktop sections 105, 121 and 123. Height h of the table-top of lectern section 101 may be adjusted relative to section 105 or section 121. A tilt of the table-top of lectern section 101 may be adjusted relative to section 105 or section 121. In certain embodiments, the table-top of lectern section 101 may adjusted to be contiguous with sections 105 and/or 121. In some embodiments, lectern section 101 may preferably be adjusted such that the table-top of lectern section 101 is substantially contiguous with sections 105 and/or 121 when height h is substantially zero. The table-top of lectern section 101, section 105 and section 121 may all lie in a single plane. The table-top of lectern section 101 may lie in a plane parallel to a plane defined by section 105 and/or a plane defined by section 121. The table-top of lectern section 101 may lie in plane that intersects a plane defined by section 105 and/or section 121. The plane defined by the table-top of lectern section 101 may intersect the plane defined by section 105 and/or a plane defined by section 121 at angle θ.

Section 121 includes a length $l_1$. Station 100 includes section 123. Section 123 includes a length $l_2$. Section 123 may be configured to rotate. Length $l_2$ of section 123 may be positioned parallel to length $l_1$ of section 121. When length $l_2$ is parallel to $l_1$, section 123 may be positioned underneath section 121.

Length $l_2$ of section 123 may be configured to be positioned perpendicular to length $l_1$ of section 121. When $l_2$ is perpendicular to length $l_1$, section 123 may be configured to extend away from section 121. When section 123 extends away from section 121, section 123 may increase a surface area of station 100.

Section 123 is supported by leg 127. Leg 127 may include caster 129. Caster 129 may be configured to swivel when section 123 is rotated.

Station 100 may be supported at a first end by base 102. Station 100 may be supported at a second end by legs 125. In some embodiments, section 123 may be configured to rotate about one of legs 125.

Station 100 includes modesty panel 117. Modesty panel 117 may include mesh 119. Mesh 119 may include diamond shaped holes. Modesty panel 117 may increase teacher comfort when the teacher is sitting at station 100.

Figure 2:
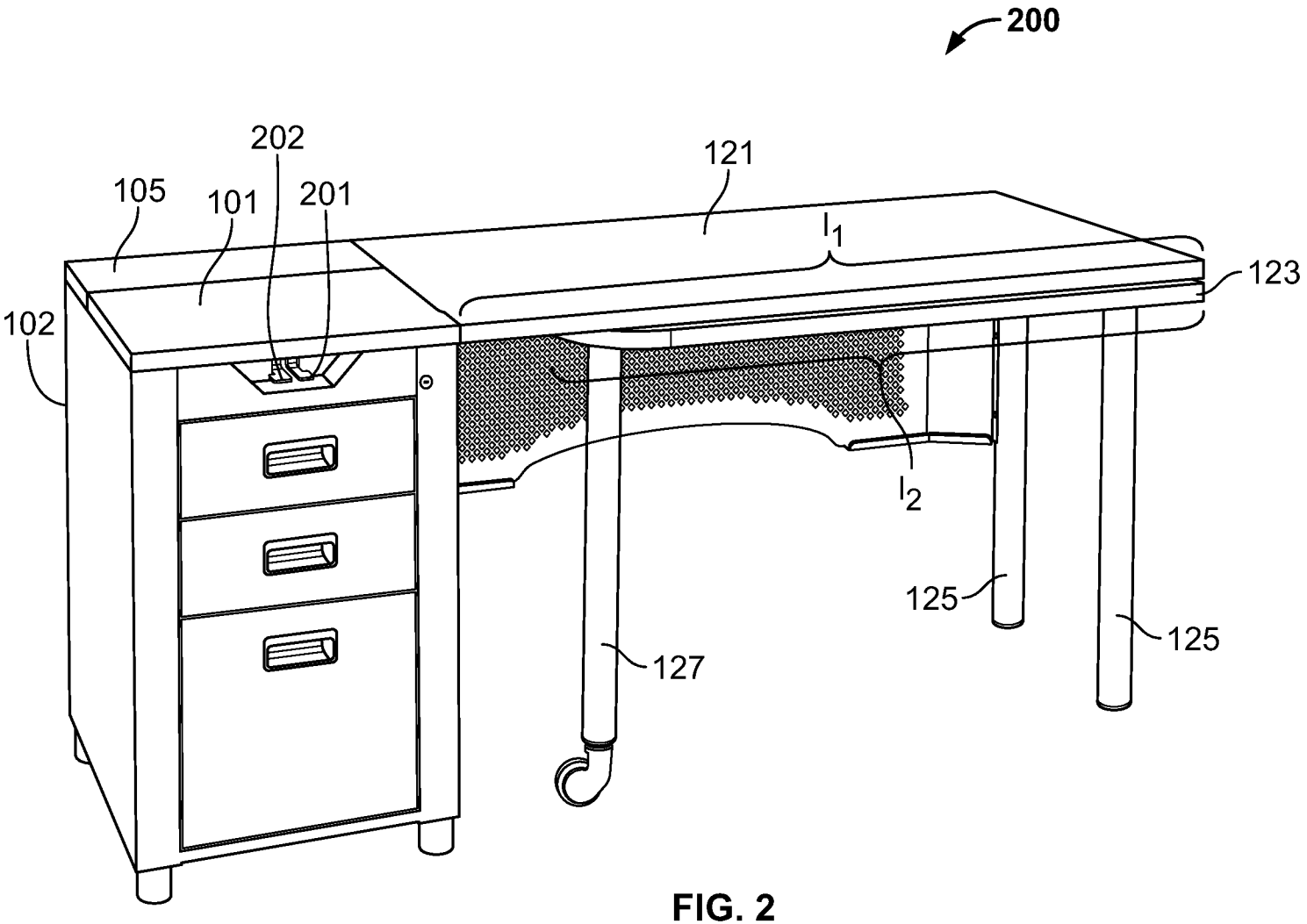
FIG. 2 shows illustrative apparatus in accordance with principles of the invention.

FIG. 2 shows illustrative teaching station 200 (hereinafter, "station 200"). Station 200 may include one or more features of station 100 (shown in FIG. 1). FIG. 2 shows the table-top of lectern section 101 in a fully retracted position. When the table-top of lectern section 101 is in a fully retracted position, a height h of the table-top of lectern section 101 relative to base 102 may be substantially zero. When the table-top of lectern section 101 is in a fully retracted position, desktop sections 101, 105 and 121 may form a substantially contiguous planar surface. Actuator 202 may preferably be used to release a lock which allows the table-top to be tilted.

Station 200 includes actuator 201. Actuator 201 may be configured to release a lock preventing an adjustment of the table-top of lectern section 101 relative to base 102. When a force is applied to actuator 201, a height of the table-top may be adjusted. When a force is applied to actuator 201, a tilt of the table-top may be adjusted.

FIG. 2 shows section 123 "tucked" underneath section 121. When section 123 is tucked underneath section 121, length $l_1$ of section 121 is parallel to length $l_2$ of section 123. Tucking section 123 underneath section 121 may reduce a footprint of station 200. Reducing the footprint of station 200 may increase unobstructed space in a classroom. Section 123 may rotate. Rotation of section 123 may position $l_2$ perpendicular to $l_1$. When $l_2$ is positioned perpendicular to $l_1$, section 123 may extend away from section 221 thereby expanding a surface area of station 200.

Figure 3:
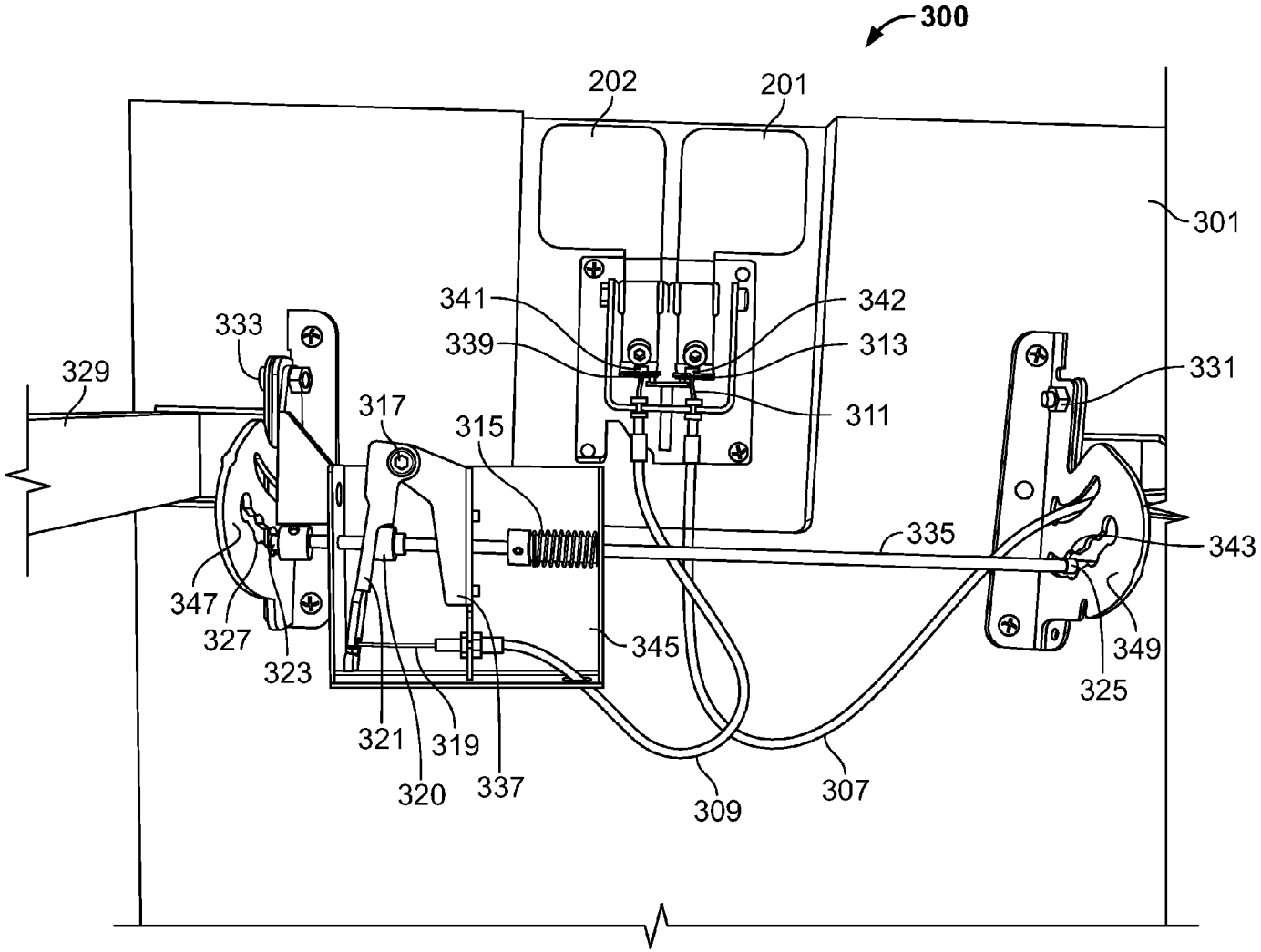
FIG. 3 shows illustrative apparatus in accordance with principles of the invention.

FIG. 3 shows an underside 301 of illustrative table-top 300. Table-top 300 may include one or more features of the table-top of lectern section 101 (shown in FIG. 1). Table-top 300 includes actuator 201 and actuator 202. Actuator 201 may be configured to control an adjustment of a height of table-top 300. Actuator 202 may be configured to control a tilt of table-top 300.

Actuator 201 includes claw 313. Claw 313 is configured to grasp cable 311. Cladding 307 may maintain a tension or position of cable 311. When a force is applied to actuator 201, claw 313 pulls cable 311. Claw 339 may grasp cable 311 via bulbous end 342.

Actuator 202 includes claw 339. When a force is applied to claw 339, claw 339 pulls cable 319. Cladding 309 may maintain a tension or position of cable 319. Claw 339 may grasp cable 319 via bulbous end 341. When claw 339 pulls cable 319, lever 321 may rotate about pivot point 317.

Table-top 300 may include elongated member 335. Elongated member 335 may include detent 323. Elongated member may include detent 325. Elongated member 335 may include stop 320. Stop 320 may be rigidly affixed to elongated member 335. Rotation of lever 321 about pivot point 317 may apply pressure to stop 320 thereby shifting elongated member 335. Shifting elongated member 335 may compress spring 315 against casing 345. Rotation of lever 321 about pivot point 317 may shift detent 323 out of notch 327. Rotation of lever 321 may shift detent 325 out of notch 343. When detent 323 and detent 325 are shifted out of notch 327 and notch 343, table-top 301 may rotate about pivot point 331 and pivot point 333. Rotating table-top 301 about pivot points 331 and 333 may correspond to adjusting a tilt of table-top 301. Rotating table-top 301 about pivot points 331 and 333 may correspond to adjusting angle θ (shown in FIG. 1).

Releasing actuator 202 allows spring 315 to expand shifting detent 323 into one of notches 327. Releasing actuator 202 allows spring 315 to expand shifting detent 325 into one of notches 343. When detents 323 and 325 are fitted into respective notches 327 and 343, a tilt position of table-top 301 is locked and table-top 301 may not rotate about pivot points 331 and 333.

Counter-lever 337 may be affixed to casing 345. Counter-lever 337 may remain stationary when lever 321 rotates about pivot point 317. Casing 345 may remain stationary when table-top 300 rotates about pivot points 331 and 333. Casing 345 may be affixed to leg 329. Leg 329 may include one or more features of leg 109 or leg 107 (shown in FIG. 1).

Rotating table-top 300 about pivot points 331 and 333 may result in wing 347 sliding between casing 345 and leg 329. Detent 323 may engage one of notches 327 from a face of wing 347 oriented toward a center of table-top 300. Detent 325 may engage one of notches 343 from a face of wing 349 oriented toward an edge of table-top 300.

Figure 4:
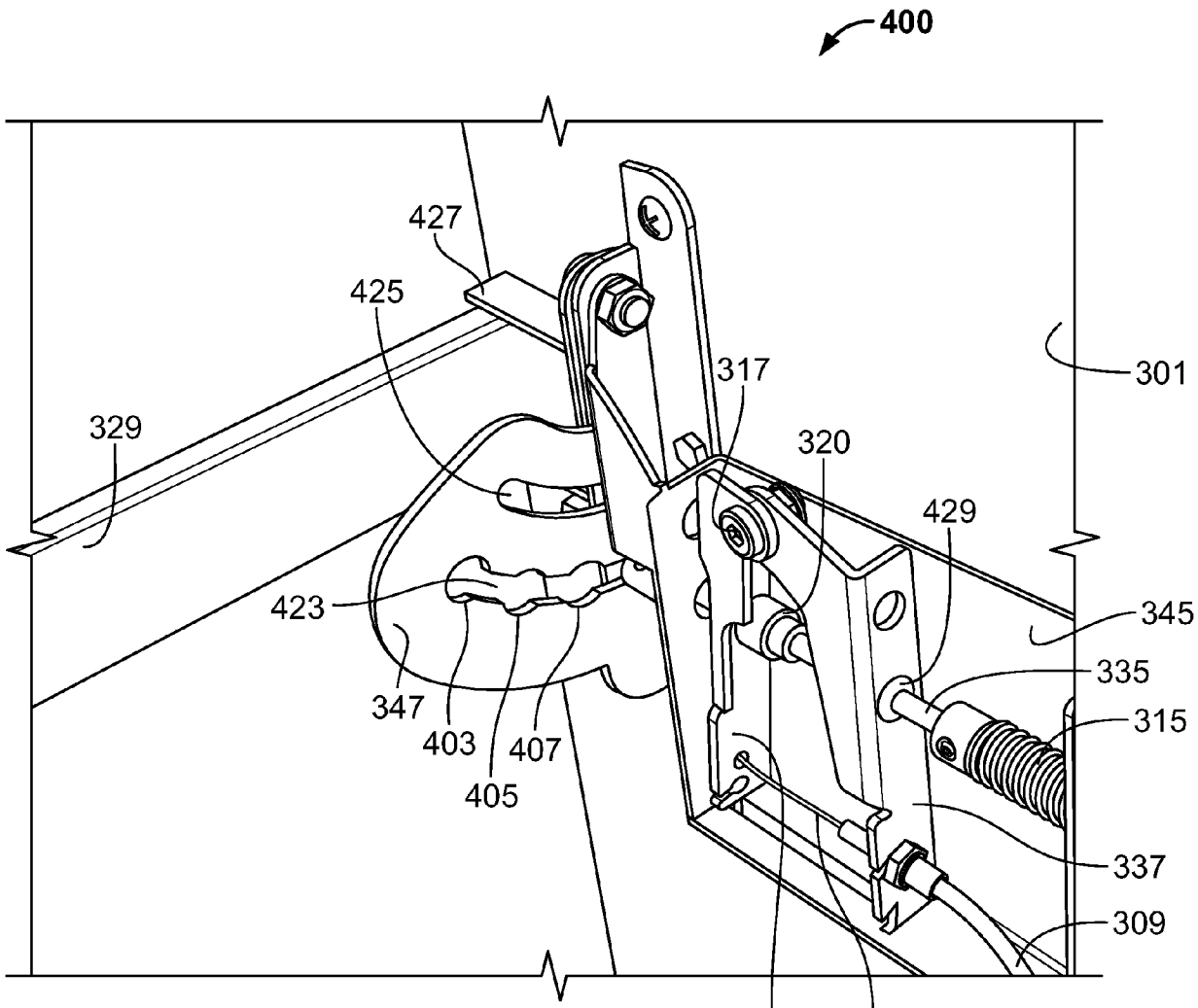
FIG. 4 shows illustrative apparatus in accordance with principles of the invention.

FIG. 4 shows a view 400 of underside 301 of table-top 300 (shown in FIG. 3).

Table-top 300 includes lever 321. Lever 321 is rotatably connected to counter-lever 337. Counter-lever 337 is affixed to casing 345. Casing 345 may be affixed to cap 427. Cap 427 may be affixed to leg 329. A force applied to actuator 202 (shown in FIG. 3) may pull cable 319 and rotate lever 321 about pivot point 317. Rotation of lever 321 may shift elongated member 335. Rotation of lever 321 may shift elongated member 335 by applying pressure to stop 320.

The shifting of elongated member 335 may compress spring 315 and shift a detent out of one of a plurality of notches in wing 347. The plurality of notches includes notches 403, 405 and 407. When a tilt of table-top 300 is adjusted, wing 347 may rotate along with table-top 300. Slot 423 in wing 347 may allow wing 347 to rotate without being obstructed by elongated member 335.

Wing 347 includes curved slot 425. A connecting bolt (not shown) may affix casing 345 to cap 427. Slot 425 may allow wing 347 to rotate without being obstructed by the connecting bolt.

Counter-lever 337 may include orifice 429. Orifice 429 may allow elongated member 335 to shift without being obstructed by counter-lever 337.

Figure 5:
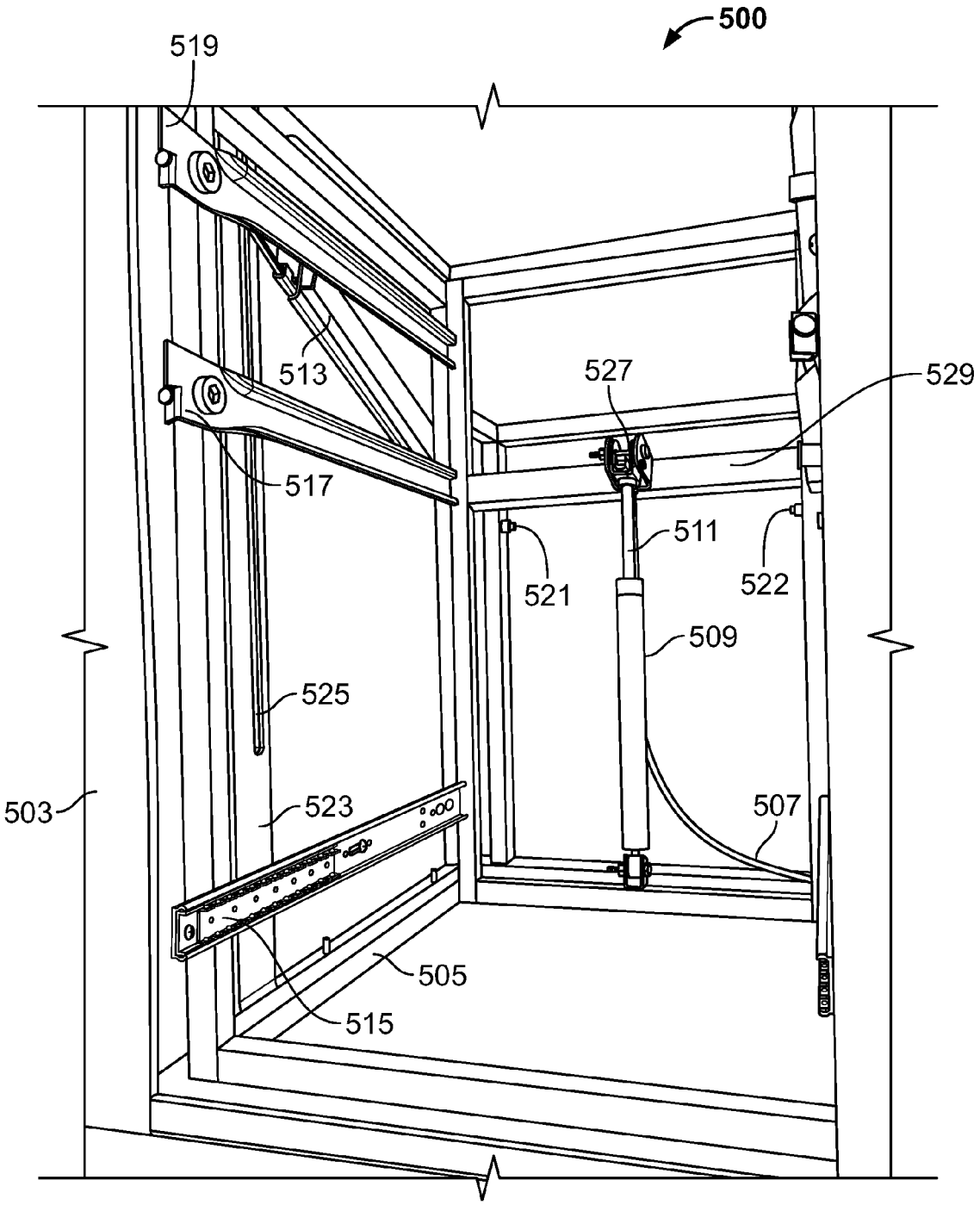
FIG. 5 shows illustrative apparatus in accordance with principles of the invention.

FIG. 5 shows illustrative apparatus 500. Apparatus 500 includes base 503. Base 503 may include one or more features of base 103 (shown in FIG. 1). Base 503 includes internal frame 505.

Apparatus 500 may include a pressure source (not shown). The pressure source may be a pneumatic cylinder, a compressed spring or any other suitable pressure source. The pressure source may be housed within fixed member 509. An end of fixed member 509 may be affixed to internal frame 505.

Rotation of cam 613 may release a brake (not shown) that maintains a position of moveable member 511 with respect to fixed member 509. Fixed member 509 is affixed to internal frame 505. Release of the brake may allow a pressure source housed within fixed member 509 to exert a force on moveable member 511. Moveable member 511 may be mechanically linked to rotatable bar 529 via brace 617 and bolt 603. A force exerted on moveable member 511 may rotate rotatable bar 529. Rotation of rotatable bar 529 may adjust a height of a table-top such as the table-top of lectern section 101 (shown in FIG. 1).

Apparatus 500 includes lock 527. In a locked position, lock 527 may be configured to prevent movement of moveable member 511. In an unlocked position, lock 527 may be configured to allow the pressure source housed in fixed member 509 to extend moveable member 511. A force applied to an actuator (such as actuator 201, shown in FIG. 3) may pull a cable enclosed by cladding 507 and switch lock 527 into an unlocked position. The cable enclosed in cladding 507 may include one or more features of cables 311 or 319. A default position of lock 527 may correspond to a locked position that prevents movement of moveable member 511.

For example, in response to switching lock 527 into an unlocked position, pressure stored within fixed member 509 may extend moveable member 511 and rotate rotatable bar 529. Rotation of rotatable bar 529 may slide extendable member 513 along slot 525 and raise a height of a table-top.

As a further example, when lock 527 is in an unlocked position, a force applied to the table-top may slide extendable member 513 along slot 525, rotate rotatable bar 529, push moveable member 511 into fixed member 509 and lower a height of the table-top. The force applied to lower the table-top may preferably be greater in magnitude than a gravitational force acting on the table-top.

The force exerted by the pressure source may preferably be greater in magnitude than a gravitational force acting on the table-top. When the force exerted by the pressure source is greater than the gravitational force, after releasing lock 527, a height of the table-top may not be lowered without applying a downward force at least greater than the gravitational force. The force exerted by the pressure source may prevent the table-top from being lowered unexpectedly in response to a release of lock 527.

Apparatus 500 includes tracks 515, 517 and 519. Tracks 515, 517 and 519 may be affixed to internal frame 505. Track 515 may hold a drawer such as drawer 111 (shown in FIG. 1). Track 517 may hold a drawer such as drawer 113 (shown in FIG. 1). Track 519 may hold a drawer such as drawer 115 (shown in FIG. 1). Each of tracks 515, 517 and 519 may allow a drawer to slide in or out of base 503.

Figure 6:
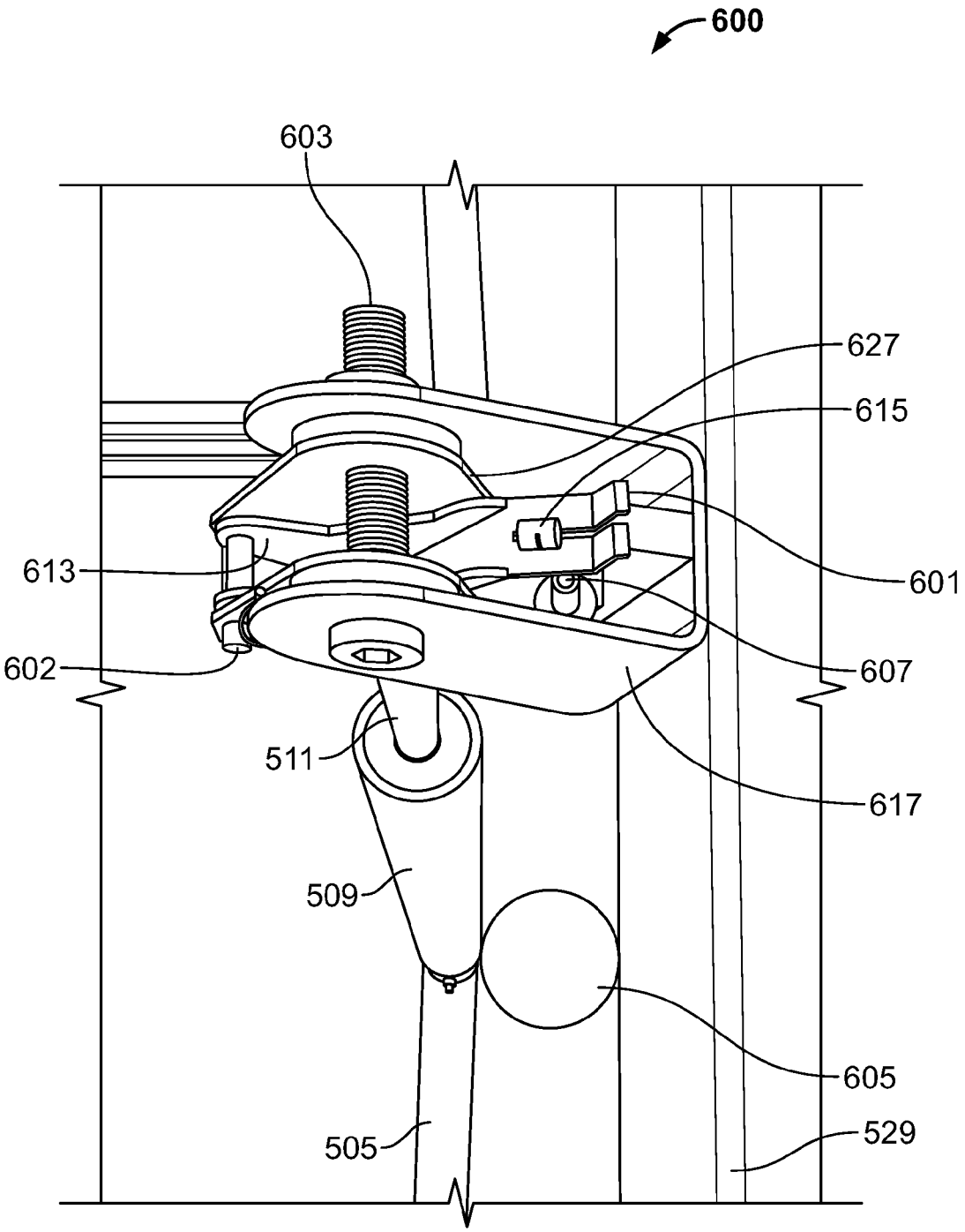
FIG. 6 shows illustrative apparatus in accordance with principles of the invention.

FIG. 6 shows illustrative view 600 of apparatus 500 (shown in FIG. 5). View 600 shows internal frame 505. View 600 shows fixed member 509. View 600 shows moveable member 511. View 600 shows rotatable bar 529.

View 600 shows lock 527. Lock 527 includes claw 601. Claw 601 may be configured to "grab" bulbous end 615 of cable 607. Cable 607 may be affixed at a second bulbous end to an actuator, such as actuator 201 (shown in FIG. 3). Movement of actuator 201 may pull cable 607. The pulling of cable 607 may engage claw 601 and rotate cam 613 about an axis defined by connector 602.

Rotation of cam 613 may release a break (not shown) that maintains a position of moveable member 511 with respect to fixed member 509. Fixed member 509 is affixed to internal frame 505. Release of the break may allow a pressure source housed within fixed member 509 to exert a force on moveable member 511. Moveable member 511 may be mechanically linked to rotatable bar 529 via brace 617 and bolt 603. A force exerted on moveable member 511 may rotate rotatable bar 529. Rotation of rotatable bar 529 may adjust a height of a table-top such as the table-top of lectern section 101 (shown in FIG. 1).

View 600 shows opening 605 in a floor of base 503. Electric cables, network cables or other equipment may pass through opening 605. Equipment that passes through opening 605 may link power/data ports 135 to an electrical source, a data source or network.

Figure 7:
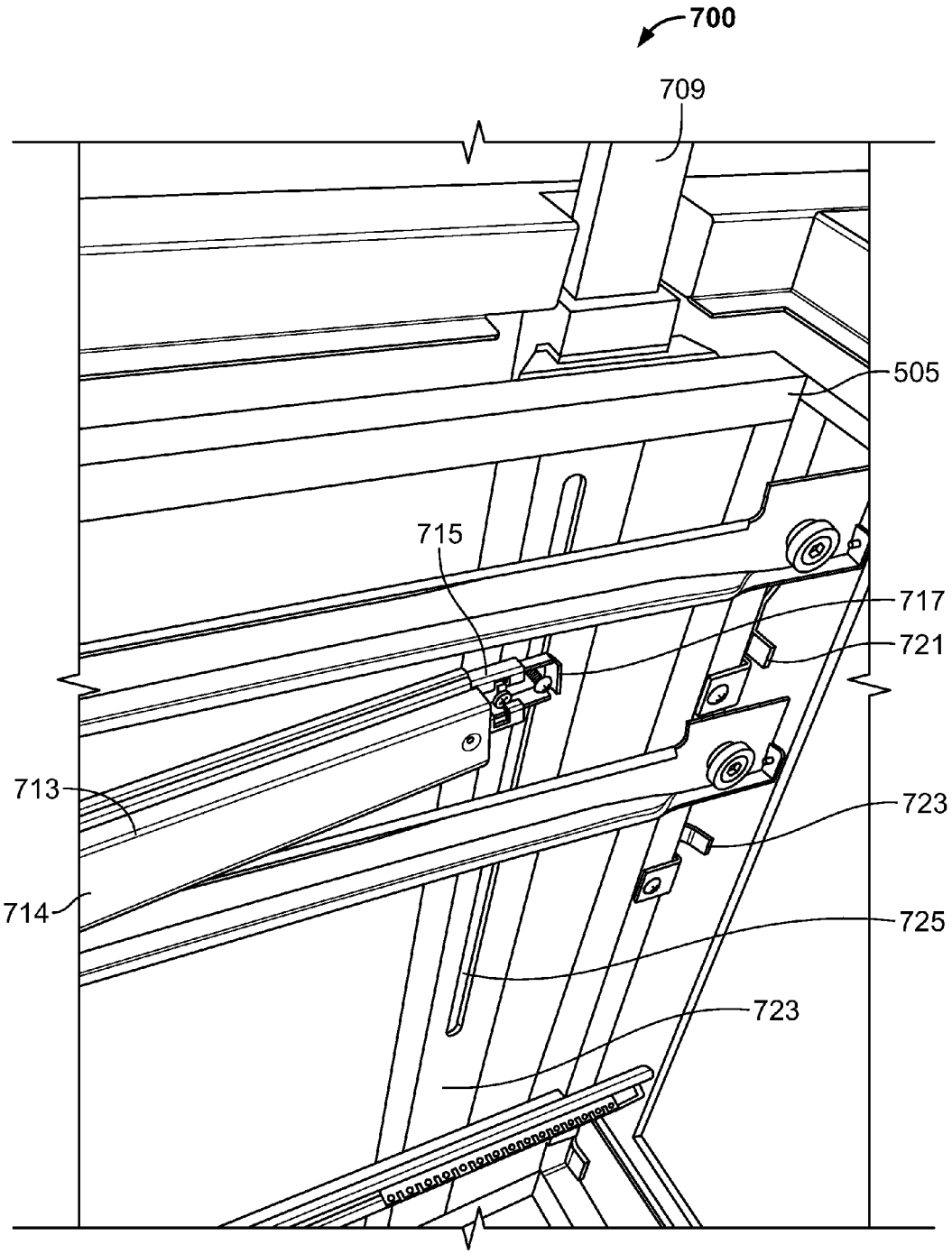
FIG. 7 shows illustrative apparatus in accordance with principles of the invention.

FIG. 7 shows view 700 of apparatus 500. View 700 shows internal frame 505. View 700 shows extendable member 713. Extendable member 713 may include one or more features of extendable member 513 (shown in FIG. 5). Extendable member 713 may include external housing 714. Extendable member 713 may include a plurality of extendable portions. For example, view 700 shows that extendable member 713 includes extendable portion 715 and extendable portion 717. Extendable member 713 may be affixed to a rotatable bar such as rotatable bar 529 (shown in FIG. 5). Extendable portions 715 and 717 may extend or contract in response to a rotation of the rotatable bar. Extendable portions 715 and 717 may extend or contract as extendable member 713 slides along slot 725.

Extendable portion 717 may be rotatably affixed to leg 709. Leg 709 may be affixed to a table-top such as the table-top of lectern section 101 (shown in FIG. 1). Leg 709 may be affixed to an underside of a table-top such as underside 301 (shown in FIG. 3). Leg 709 may slide within housing 723. A connector linking extendable portion 717 to leg 709 may pass through slot 725 in housing 723. In response to rotation of the rotatable bar, extendable member 713 may slide leg 709 within housing 723.

In response to a downward force applied to a table-top affixed to leg 709, leg 709 may be lowered within housing 723. Lowering leg 709 within housing 723 may rotate extendable member 713 and a rotatable bar affixed to extendable member 713. Rotation of the rotatable bar affixed to extendable member 713 may overcome an upward force exerted by a pressure source housed within fixed member 509 (shown in FIG. 5).

In response to a force applied to an actuator, such as actuator 201 (shown in FIG. 3), a pressure source releases pressure configured to rotate a rotatable bar (such as rotatable bar 529, shown in FIG. 5) and extendable member 713. Rotation of the rotatable bar and extendable member 713 may raise leg 709 within housing 723, thereby raising a height of the table-top of the lectern section.

Figure 8:
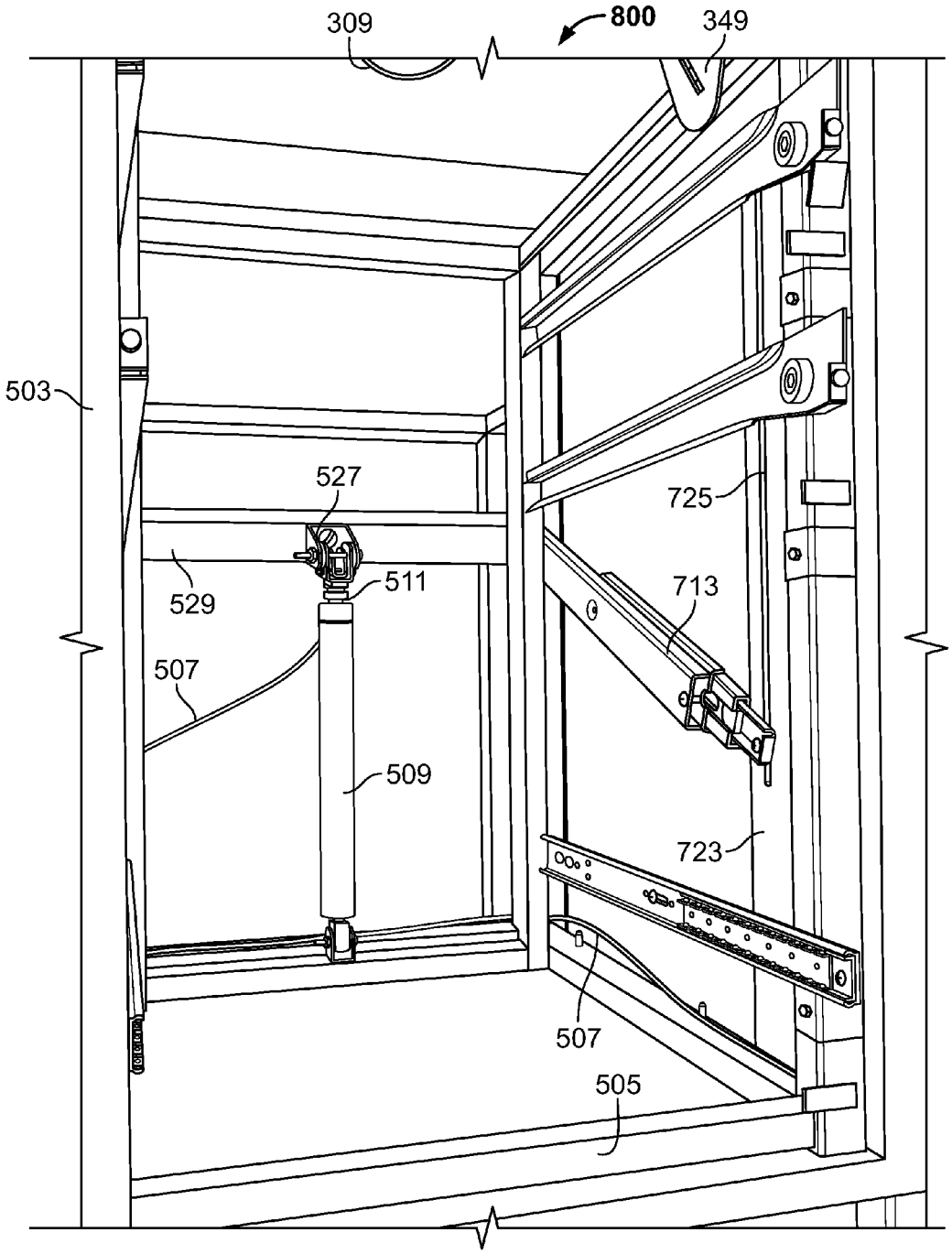
FIG. 8 shows illustrative apparatus in accordance with principles of the invention.

FIG. 8 shows view 800 of apparatus 500. View 800 may correspond to a view of apparatus 500 when a table-top, such as the table-top of lectern section 101 (shown in FIG. 1) is at a lowest height with respect to a base, such as base 103 (shown in FIG. 1). In certain embodiments, when the table-top of lectern section 101 is at a lowest height with respect to base 103, then the table-top of lectern section 101, section 105 and section 121 may all be substantially coplanar.

View 800 shows moveable member 511 positioned substantially fully within fixed member 509. When moveable member 511 is positioned substantially fully within fixed member 509, extendable member 713 may be at or near a bottom of slot 725 in housing 723. When extendable member 713 is at or near the bottom of slot 725, a leg such as leg 709 (shown in FIG. 7) affixed to extendable member 713 may be substantially enclosed within housing 723.

Applying a force to an actuator such as actuator 201 (shown in FIG. 3) may pull a cable enclosed within cladding 507. Pulling the cable within cable 507 may release lock 527 and allow expansion or retraction of moveable member 511. Releasing a force applied to the actuator may apply lock 527 and restrict expansion or retraction of moveable member 511. Applying lock 527 may prevent an adjustment of a height of the table-top relative to base 503.

Apparatus and methods described herein are illustrative. Apparatus and methods of the invention may involve some or all of the features of the illustrative apparatus and/or some or all of the steps of the illustrative methods. The steps of the methods may be performed in an order other than the order shown and described herein. Some embodiments of the invention may omit steps shown and described in connection with the illustrative methods. Some embodiments of the invention may include steps that are not shown and described in connection with the illustrative methods.

The invention may be operational with numerous other general purpose or special purpose computing system environments or configurations. For example, control of the table-top of the lectern section, expandable, contractible and otherwise moveable apparatus may be controlled by a computer system. Examples of well-known computing systems, environments, and/or configurations that may be suitable for use with the invention include, but are not limited to, personal computers, server computers, hand-held or laptop devices, mobile phones and/or other personal digital assistants ("PDAs"), multiprocessor systems, microprocessor-based systems, set top boxes, programmable consumer electronics, network PCs, minicomputers, mainframe computers, distributed computing environments that include any of the above systems or devices, and the like. In a distributed computing environment, devices that perform the same or similar function may be viewed as being part of a "module" even if the devices are separate (whether local or remote) from each other.

The invention may be described in the general context of computer-executable instructions, such as program modules, being executed by a computer. Generally, program modules may include routines, programs, objects, components, data structures, etc., that perform particular tasks or store or process data structures, objects and other data types. The invention may also be practiced in distributed computing environments where tasks are performed by separate (local or remote) processing devices that are linked through a communications network. In a distributed computing environment, program modules may be located in both local and remote computer storage media including memory storage devices.

Although the invention has been described in terms of particular embodiments and applications, one of ordinary skill in the art, in light of this teaching, can generate additional embodiments and modifications without departing from the spirit of or exceeding the scope of the principles of the invention. Accordingly, it is to be understood that the drawings and descriptions herein are proffered by way of example to facilitate comprehension of the invention and should not be construed to limit the scope thereof. Persons skilled in the art will appreciate that the present invention can be practiced in embodiments other than the described embodiments, which are presented for purposes of illustration rather than of limitation, and that the present invention is limited only by the claims that follow.

What is claimed is:

1. A teaching station comprising:

a desktop;

an adjustable lectern section, the adjustable lectern section comprising:

a table-top;

a first leg; and a second leg;

a base comprising:

a first housing for the first leg;

a second housing for the second leg; and a non-adjustable section of the desktop substantially perpendicular to the first and second legs; and a safety mechanism for adjusting a height of the table-top relative to the desktop, the safety mechanism comprising:

a frame mounted inside the base;

a pressure source affixed to the frame;

a rotatable bar mounted on the frame and coupled to the first leg and the second leg;

a moveable member, responsive to pressure exerted by the pressure source, and mechanically coupled to the rotatable bar, such that in response to pressure exerted by the pressure source, the moveable member is configured to rotate the rotatable bar; and an actuator affixed to an underside of the table-top, and mechanically coupled to a first end of a cable, wherein in response to actuation of the actuator, a second end of the cable is configured to rotate a cam that releases pressure from the pressure source.

2. The teaching station of claim 1 further comprising:

a first hinge pivotally coupling the table-top to the first leg;

second hinge pivotally coupling the table-top the second leg;

wherein a pivoting of the table-top about the first hinge and the second hinge adjusts an angle of the table-top relative to the desktop.

3. The teaching station of claim 1 wherein when the table-top is in a first state, the table-top section is configured to be coplanar with the desktop.

4. The teaching station of claim 3 wherein when the table-top section is in a second state, the adjustable table-top section is configured to be positioned in a first plane that intersects a second plane defined by the desktop.

5. The teaching station of claim 1 wherein when the table-top is in a first state, the table-top is configured to be non-coplanar with the desktop, and wherein when the table-top is in a second state the table top is configured to be coplanar with the desktop.

6. The teaching station of claim 1 wherein when the height of the table-top is at a minimum, the table-top and the non-adjustable section form a substantially contiguous plane with the desktop.

7. The teaching station of claim 1, wherein when the desktop is a first non-adjustable section, the teaching station further comprising a second non-adjustable section, wherein when the adjustable table-top section is at a minimum height, the adjustable table-top section, the first non-adjustable section and the second non-adjustable section form a substantially contiguous plane.

8. The teaching station of claim 1 the frame further comprising a track configured to hold a drawer;

wherein the safety mechanism does not impede a sliding of the drawer along the track.

* * * * *